US009142134B2

(12) United States Patent
White

(10) Patent No.: US 9,142,134 B2
(45) Date of Patent: Sep. 22, 2015

(54) SYSTEM AND METHOD FOR PROVIDING PREDICTIVE DEPARTURE AND ARRIVAL RATES FOR AN AIRPORT

(75) Inventor: Thomas White, Huntington, NY (US)

(73) Assignee: PASSUR AEROSPACE, INC., Stamford, CT (US)

( * ) Notice: Subject to any disclaimer, the term of this patent is extended or adjusted under 35 U.S.C. 154(b) by 444 days.

(21) Appl. No.: 12/960,966

(22) Filed: Dec. 6, 2010

(65) Prior Publication Data

US 2011/0301829 A1 Dec. 8, 2011

Related U.S. Application Data

(60) Provisional application No. 61/266,626, filed on Dec. 4, 2009.

(51) Int. Cl.
*G08G 5/00* (2006.01)
*G08G 5/06* (2006.01)

(52) U.S. Cl.
CPC ..... *G08G 5/0043* (2013.01); *G08G 5/0026* (2013.01); *G08G 5/0082* (2013.01); *G08G 5/0017* (2013.01)

(58) Field of Classification Search
CPC ..... G08G 5/00; G08G 5/0017; G08G 5/0026; G08G 5/0043; G08G 5/0092; G08G 5/0095; G06Q 10/04; G06Q 10/06; G06Q 10/025; G06Q 10/02; G06Q 10/047; G06F 17/30; G06F 17/300014; G06F 17/3087
USPC ..... 701/120, 123, 4, 465, 117, 118, 13, 14, 701/300, 414, 467, 492, 528, 532; 702/3, 702/179; 703/6; 705/5, 6; 340/935, 947, 340/501, 521, 539.28, 945, 970, 971
See application file for complete search history.

(56) References Cited

U.S. PATENT DOCUMENTS

| | | | | |
|---|---|---|---|---|
| 7,720,630 | B1 * | 5/2010 | Miller et al. | 702/150 |
| 2003/0195693 | A1 * | 10/2003 | Flynn et al. | 701/120 |
| 2009/0276250 | A1 * | 11/2009 | King et al. | 705/5 |

OTHER PUBLICATIONS

David A. Smith and Dr. Lance Sherry, Decision Support Tool for Predicting Aircraft Arrival Rates from Weather Forecasts May 7, 2008, IEEE 978-1-4244-2304-0/08.*
National Weather Service Instruction 10-813, Terminal Aerodrome Forecasts, Dec. 18, 2008, Appendix C.*
Alexander Klein et al., Airport Delay Prediction Using Weather-Impacted Traffic Index Model , Oct. 7, 2010, IEEE 978-1-4244-6618-4/10.*
All Weather Inc., Automated Weather Observing System, Mar. 6, 2003.*

* cited by examiner

*Primary Examiner* — Calvin Cheung
*Assistant Examiner* — Kevin P Mahne
(74) *Attorney, Agent, or Firm* — Fay Kaplun & Marcin, LLP

(57) ABSTRACT

A system and method for determining estimated departure and arrival rates. The system and method including receiving predicted airport constraint information for a predetermined time period, querying historical airport data to determine historical time periods having similar constraint information and determining an estimated arrival rate and an estimated departure rate for the predetermined time period based on corresponding arrival rates and departure rates for the historical time periods having similar constraint information.

15 Claims, 5 Drawing Sheets

250 260 270 200

To FIG. 3A

| Curr GDP | Runway | Weather (TAF) | Row Scenario |
|---|---|---|---|
| | A: 22L 04R<br>D: 31L 22R 04L | VFR: WIND 310 at 10KT | No Scenario |
| | A: 04R 22L<br>D: 31L 04R 22R | VFR: WIND 310 at 10KT | No Scenario |
| | A: 31R 04R 31L<br>D: 31L 04L | VFR: WIND 310 at 10KT | No Scenario |
| | A: 31R 31L 04R<br>D: 31L | VFR: WIND 310 at 10KT | No Scenario |
| | A: 31R 31L<br>D: 31L | VFR: WIND 310 at 10KT | No Scenario |
| | A: 31R 31L<br>D: 31L | VFR: WIND 310 at 10KT | No Scenario |
| | A: 31R 31L<br>D: 31L | VFR: WIND 310 at 10KT | No Scenario |
| | A: 31R 31L<br>D: 31L | VFR: WIND 310 at 10KT | No Scenario |

| Hold | Runway | Weather (METAR) | Row Scenario |
|---|---|---|---|
| 0 | A: 31R<br>D: 31L | VFR: WIND 340 at 7KT | No Scenario |
| 0 | *A: 31R<br>*D: 31L | VFR: WIND 350 at 7KT | No Scenario |

FIG. 3B

SYSTEM AND METHOD FOR PROVIDING PREDICTIVE DEPARTURE AND ARRIVAL RATES FOR AN AIRPORT

PRIORITY CLAIM/INCORPORATION BY REFERENCE

This application claims priority to U.S. Provisional Application Ser. No. 61/266,626 entitled "System and Method for Providing Predictive Departure and Arrival Rates for an Airport" that was filed on Dec. 4, 2009 and names Thomas White as inventor. The entirety of that application is hereby expressly incorporated by reference into this application.

BACKGROUND

The goal of every airport is to provide as many take-off and landing slots as possible so that the greatest number of aircraft can take off and land. In order to provide the most efficient slot scheduling, it would be very helpful if the airport operator can determine the expected demand at any particular time during the day and smooth out any demand/capacity imbalances. However, there presently is no manner of determining such demands to be able to smooth out the imbalances

SUMMARY

A method for receiving predicted airport constraint information for a predetermined time period, querying historical airport data to determine historical time periods having similar constraint information and determining one of an estimated arrival rate and an estimated departure rate for the predetermined time period based on corresponding arrival rates and departure rates for the historical time periods having similar constraint information.

A system having a data receiving arrangement receiving predicted airport constraint information for a predetermined time period and a processor querying historical airport data to determine historical time periods having similar constraint information and determining one of an estimated arrival rate and an estimated departure rate for the predetermined time period based on corresponding arrival rates and departure rates for the historical time periods having similar constraint information.

A system having a non-transitory memory storing a set of instructions executable by a processor. The set of instructions being operable to receive predicted airport constraint information for a predetermined time period, query historical airport data to determine historical time periods having similar constraint information and determine one of an estimated arrival rate and an estimated departure rate for the predetermined time period based on corresponding arrival rates and departure rates for the historical time periods having similar constraint information.

DETAILED DESCRIPTION

Figure 1:
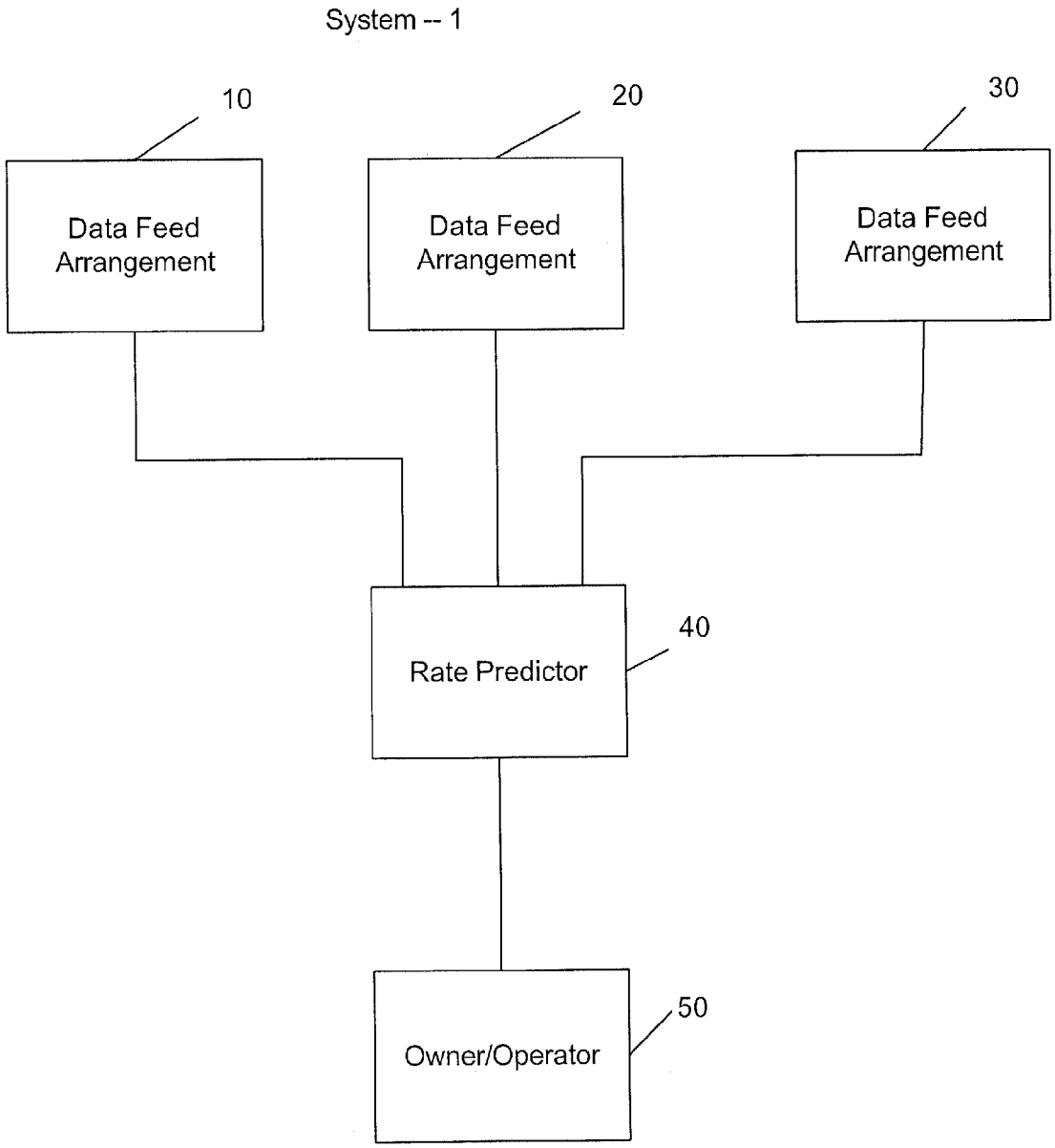
FIG. 1 shows an exemplary system for providing fuel information for aircraft.

The exemplary embodiments may be further understood with reference to the following description and appended drawings, wherein like elements are referred to with the same reference numerals. The exemplary embodiments provide systems and methods for providing predictive departure and arrival rates for an airport.

FIG. 1 shows an exemplary system 1 for predicting departure and arrival rates for an airport. The exemplary system includes three data feed arrangements 10-30. These data feed arrangements 10-30 provide data to a rate predictor 40. Examples of the data provided by the data feed arrangements 10-30 to the rate predictor 40 will be described in greater detail below. The rate predictor 40 may use this input data along with saved data and/or additional data provided by the airport operator 50 to determine the predicted departure and arrival rates for a given time period. The rate predictor 40 will then provide this information to the airport operator 50 for their use. The operation of each of the components of the system 1 will be described in greater detail below.

The data feed arrangements 10-30 may be any system that provides the data as will be described below. This may include government data feeds such as FAA data feeds, National Weather Service feeds, etc. Other types of data feeds may be third-party private data feeds, airport specific data feeds, owner/operator data feeds, etc. It is noted that the source of the data is not relevant to the exemplary embodiments. In addition, the illustration of three data feed arrangements 10-30 is only exemplary. There may be less or more data feed arrangements providing data to the rate predictor 40.

The rate predictor 40 may be used to predict demand/capacity imbalances at an airport. The initial metric for comparison is defined as a normal Visual Flight Rules (VFR) arrival and departure rates for a given day of the week and hour of the day. These departure and arrival rates may be defined as the optimal unimpeded demand numbers for a given hour of the day of the week. It should be noted that using this metric as the baseline is only exemplary and it is possible to define other optimal metrics for the purpose of comparison.

However, those skilled in the art will understand that the above metric defines the optimal situation for the airport and that not every situation is optimal and there may be circumstances that prevent the airport from operating at optimal capacity. These circumstances may be referred to as constraints on the optimal operation of the airport facility. The constraints may include such things as weather constraints or facilities constraints (e.g., a pothole in a runway requiring a runway shutdown for a period of time). In the exemplary embodiments, the example of a weather constraint will be used, but as described above, a constraint may be any occurrence that causes the airport to deviate from the optimal arrival and departure rates.

Those skilled in the art will understand that during operation, the more likely scenario is a non-optimal scenario where it is not possible to have the optimal arrival and departure rates. Thus, the airport operator 50 needs to accommodate these non-optimal occurrences, but in order to make such accommodations, the airport operator 50 will need notice that such an occurrence may happen. The exemplary embodiments provide for predictive arrival and departure rates for different scenarios such that the airport operator 50 may handle such occurrences.

The data received by the rate predictor 40 from the data feed arrangements 10-30 is current information relating to the airport. Examples of this information may include weather information, runway configurations, actual departure and arrival rates, flight schedules, etc. As described above, this information may come from a variety of information sources. In addition, to the current airport information, the rate predictor 40 may also store historical airport information. This historical airport information (e.g., weather, runway configurations, actual departure and arrival rates) may be continuously received from the data feed arrangements 10-30 and stored locally or remotely by the rate predictor 40 for use as described in greater detail below.

The rate predictor 40 will use actual data from similar times and conditions to predict the arrival and departure rates for the current day. In one example, the rate predictor 40 will receive as input the Terminal Aerodrome Forecasts (TAF) for the next 8 hours. The rate predictor 40 will use this TAF to query for similar conditions and then predict arrival and departure rates based on stored historical data. For example, one of the data feed arrangements 10-30 may provide the rate predictor 40 with the TAF for the next eight hours that is forecasted to be wind from the Northwest at 10 knots. Those skilled in the art will understand that these conditions are not optimal and thus, the TAF is a constraint on the optimal capacity. However, the airport operator 50 would like to know what the predicted arrival and departure rates will be over that eight hour period so that it can accommodate flight schedules. It should be noted that the use of a TAF that is constant over the eight hour period is only exemplary and that each hour or even partial hours may be different. In addition, the use of an eight-hour predictive period is also exemplary and other time periods may also be used.

Upon receiving the TAF, the rate predictor 40 will use stored historical data to arrive at a predicted departure and arrival rate for each hour of the eight-hour prediction window. The stored historical data may include an actual number of landings and takeoffs per hour under similar weather conditions (e.g., similar constraints). Those skilled in the art will understand that similar constraints may be defined in a number of manners and may be individual to an airport or may be based on general rules. Carrying through with the above example, it may be that northwest winds of 10 knots may be considered to be similar to northwest winds from 5 knots to 15 knots and north winds from 5 knots to 10 knots. Thus, the historical data from time periods having these weather conditions may be determined and analyzed in predicting the arrival and departure rates. Again, these ranges may be based on empirical determination that are individual to an airport or may be more general rules and can be altered during operation of the rate predictor 40.

After analyzing the historical data, the rate predictor 40 may take an average of the number of departures and arrivals for these similar conditions and provide the estimated departure and arrival rates. The amount of historical data used to make the estimation may vary. In one example, the rate predictor 40 may use historical data from the past 3 months. In another example, the rate predictor 40 may use the past 30 events having similar constraints. As can be seen from these examples, there is a wide range of historical data that may be used for prediction purposes.

In addition, other input data may also be used to provide a more accurate prediction. For example, the input data to the rate predictor 40 may also include the current runway configuration for the airport, e.g., the runways that will be used for arrivals and departures. This data may be used to further refine the search of historical data. For example, the rate predictor 40 may search for periods that have similar weather constraints and runway configurations when determining the estimated arrival and departure rates.

In another example, the rate predictor 40 may be constrained by the day and/or time of day. For example, when searching for similar weather constraints and runway configurations, the rate predictor 40 may also limit the search to similar days (e.g., weekdays, weekends, Fridays, etc.) and/or to similar times (e.g., the specific hour for which the prediction will be made and the two hours around that time). Thus, if additional parameters are provided to the rate predictor 40 for the search of the historical data, the accuracy of the estimated arrival and departure rates may increase.

Figure 2:
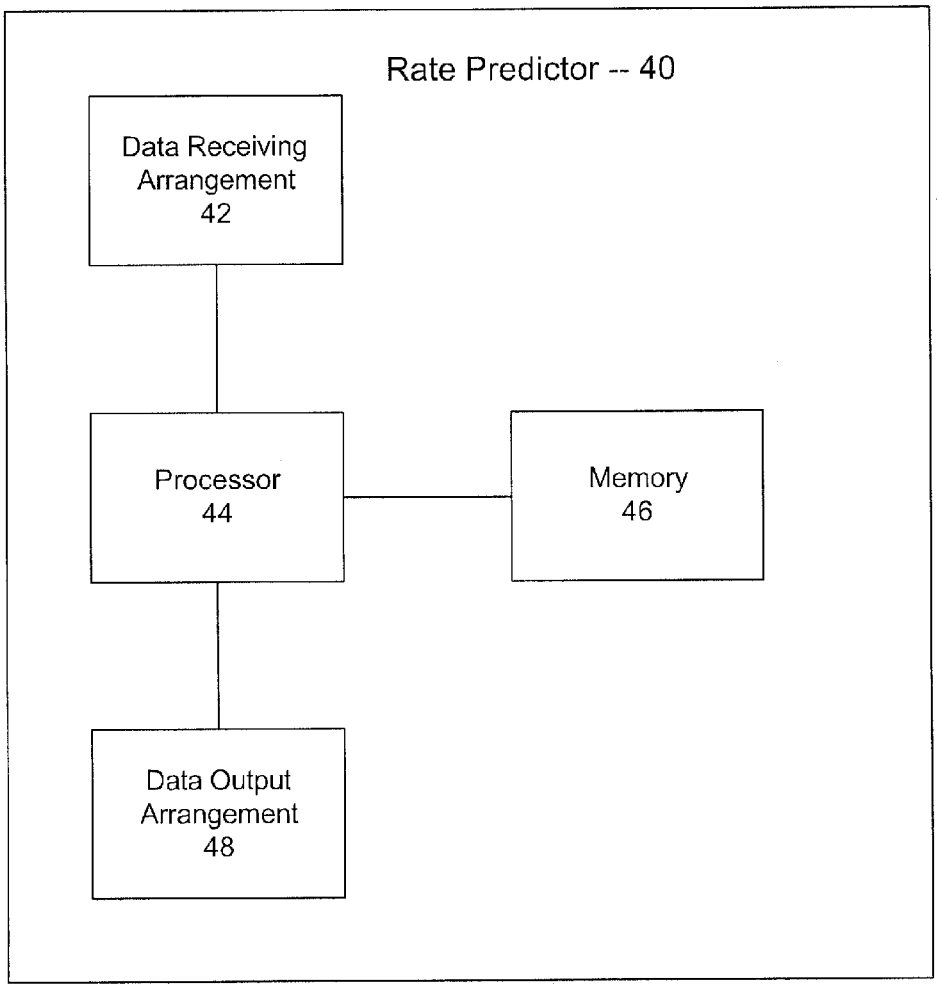
FIG. 2 shows an exemplary embodiment of the rate predictor.

FIG. 2 shows an exemplary embodiment of the rate predictor 40. This exemplary embodiment of the rate predictor 40 includes a data receiving arrangement 42, a processor 44, a memory 46 and a data output arrangement 48. In one exemplary embodiment, the rate predictor 40 and its associated components 42-48 may be embodied in a server device. The data receiving arrangement 42 is configured to receive the data from the data feed arrangements 10-30, but may also be configured to receive other input data from, for example, the airport operator 50. This data is provided to the processor 44 to be used to determine the estimated arrival and departure rates in conjunction with the data stored in memory 46. The determination of the estimated departure and arrival rates by the processor 44 may be based on the processor 44 executing instructions of a computer program stored in memory 46. The data such as the historical data described above may be stored in a database in memory 46, but other data storage arrangements may also be used. When the processor 44 has calculated the estimated arrival and departure rates, this information may be provided to the data output arrangement 48, which is configured to output the estimated arrival and departure rates to the airport operator 50. It is noted that the output may be a visual output such as a web page or similar visual indication of the estimated arrival and departure rates as will be described in greater detail below. The embodiment of a server is only exemplary and those skilled in the art will understand that the functionality described herein for the rate predictor 40 may be included in any type of computing device and that the functionality may be distributed to multiple devices.

Figure 3A:
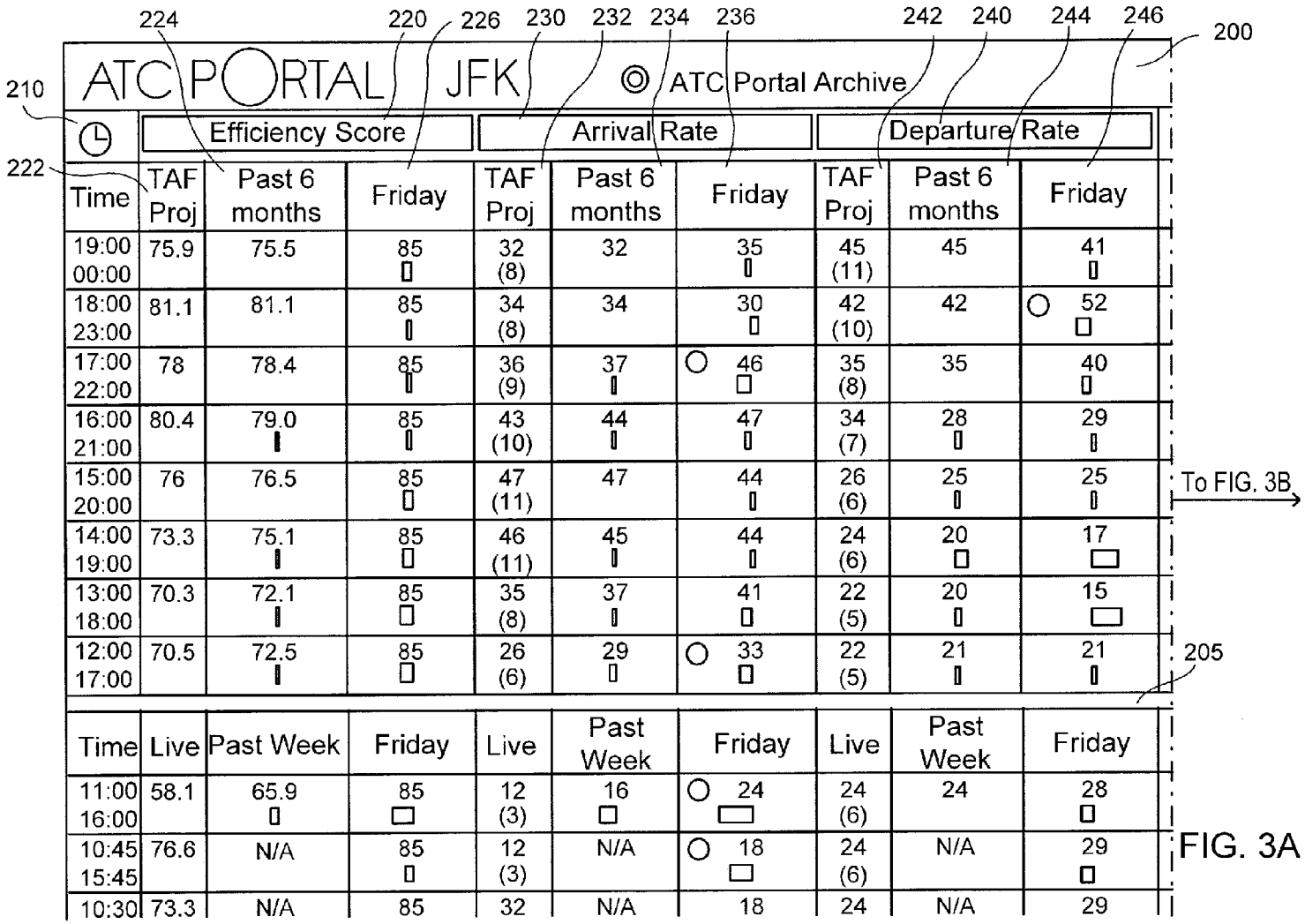
FIG. 3 shows an exemplary display 200 that includes the estimated arrival and departure rates for an airport.

FIG. 3 shows an exemplary display 200 that includes the estimated arrival and departure rates for an airport. The display 200 includes a separation 205 between actual live data and the estimated data. The data that is displayed below the separation 205 is the indication of actual data pertaining to arrival and departure rates, actual weather conditions, etc. This information is not relevant to the exemplary embodiments and will not be described in greater detail. The information that is displayed above the separation 205 relates to the estimated arrival and departure rates and will be described in greater detail.

In a first column 210, the time of the estimates is provided. Thus in this example, the next hour above the separation 205 is 12:00, followed by 13:00, and all the way through 19:00. Thus, as with the example above, this display 200 provides estimates for the next 8-hour window 12:00-19:00. The next 3 columns 222-226 is related to an efficiency score 220 that will be described in greater detail below. The following three columns 232-236 are related to the estimated arrival rate 230, followed by the columns 242-246 related to the estimated departure rate 240. The flowing columns display the runway configuration 250, the predicted TAF 260 and a possible scenario 270.

Continuing with the example started above, the display 200 shows in column 260 that the predicted TAF weather is for visual flight rules (VFR) with a wind 310 (Northwest) at 10 knots. It is shown that the weather is predicted to be the same over the entire 8-hour period. The column 250 shows the predicted runway configurations over the prediction time period. In this example, there are some runway configuration changes that will occur.

As described above, this weather and/or runway configurations may present constraints from the optimal departure and arrival rates. The rate predictor 40 receives the weather and/or runway configuration information and searches the historical data for the airport to predict the departure and arrival rates. To provide a specific example, referring to the first predicted hour (row 12:00), the predicted arrival rate for the TAF projection 232 is 26 arrivals as shown on display 200. It is noted that the value 26 is the estimate of arrivals for the one-hour period from 12:00-13:00. In this embodiment, the value (6) shown under the value 26 indicates the number of arrivals based on a 15-minute interval, within the hour, rather than the full hour. As described, this estimated arrival rate is described as the TAF projection 232. Thus, it may be surmised that the estimate is based on the TAF weather projection, but may also include other factors as described above. For example, the rate predictor 40 may query the historical data for weather conditions similar to the noted visual flight rules (VFR) with a wind 310 (Northwest) at 10 knots. The rate predictor 40 may then determine the actual number of arrivals per hour for these similar weather constraints and average the results to determine the predicted arrival rate (e.g., 26). As described above, the number of samples that are used for averaging may vary depending on a general rule that is set or a user preference. For example, the samples may be all times that satisfy the constraints for the past three months, the last 30 events that satisfy the constraints, etc. In addition, the TAF projection 232 may also include other data that was incorporated into the search such as the runway configuration 250.

The column 234 shows the predicted arrival rate based on the data for the past 6 months. As described above, the TAF projection 232 is the default. However, the user may set another search criteria and display this result in column 234. Thus, in this example, the user has decided to look at the past 6 months rather than just the default value of the TAF projection 232. The result of this query by the rate projector 40 indicates that the estimated arrival rate based on the last six months of historical data is 29 as shown in column 234. The difference between the TAF projection 232 and the user selected search criteria in column 234 is a result of different data being averaged. As described above, the TAF projection 232 may be based on the last three months of data, while the user-selected criteria is six months worth of historical data. The reason for the differences in the data may be the result of for example, schedule changes, etc.

The next arrival rate 230 related column 236 is another user selected query. In this example, the user has selected a specific query for Friday from 12:00-1:00. That is the query is directed not only to the specific weather and/or runway configurations, but also to the specific day/time for the prediction. As can be seen from this example, the estimate arrival rate for this query is 33. This is a significant variance from the TAF prediction of 26 arrivals. Thus, the display 200 includes a visual indication (in this case a colored button) in the upper quadrant to alert the airport operator of the divergence. This alerts the airport operator that the TAF projection 232 is different from what the historical data records for this particular day/time. This may indicate to the airport operator that there is some other constraint that is limiting the estimated arrival rate.

In addition, there are also graphical displays underneath the values provided in columns 234 and 236. These graphical displays indicate the amount of variance that the value in these columns have from the TAF projection in column 232. A green graphical display may indicate the value in columns 234 and 236 are greater than the TAF projection 232 value, while a red graphical display may indicate the value in columns 234 and 236 are less than the TAF projection 232 value. However, any type of graphical display that is useful in conveying this information may be used.

The estimated departure rate 240 includes the same general columns determined in the same manner as the estimated arrival rates, e.g., the TAF projection 242, a first user selected query period 244 and a second user selected query period 246.

The efficiency score 220 relates to the estimated arrival and departure rates versus the optimal rates described above. Thus, for the 12:00-1:00 estimated time frame, the TAF projections for arrivals 26 and departures 22 is 70.5% of the optimal number of departures and arrivals at this time period as shown in column 222. Columns 224 and 226 show the efficiency scores for the user selected query arrival and departure rates.

Finally, the row scenario button allows the user to select different scenarios such as different runway configurations or traffic flows on the airport to determine if the different scenario may result in a different predicted arrival and departure rates. By changing these scenarios, the user may determine that there is a configuration or traffic flow that results in a more optimal departure and arrival rate.

Figure 4:
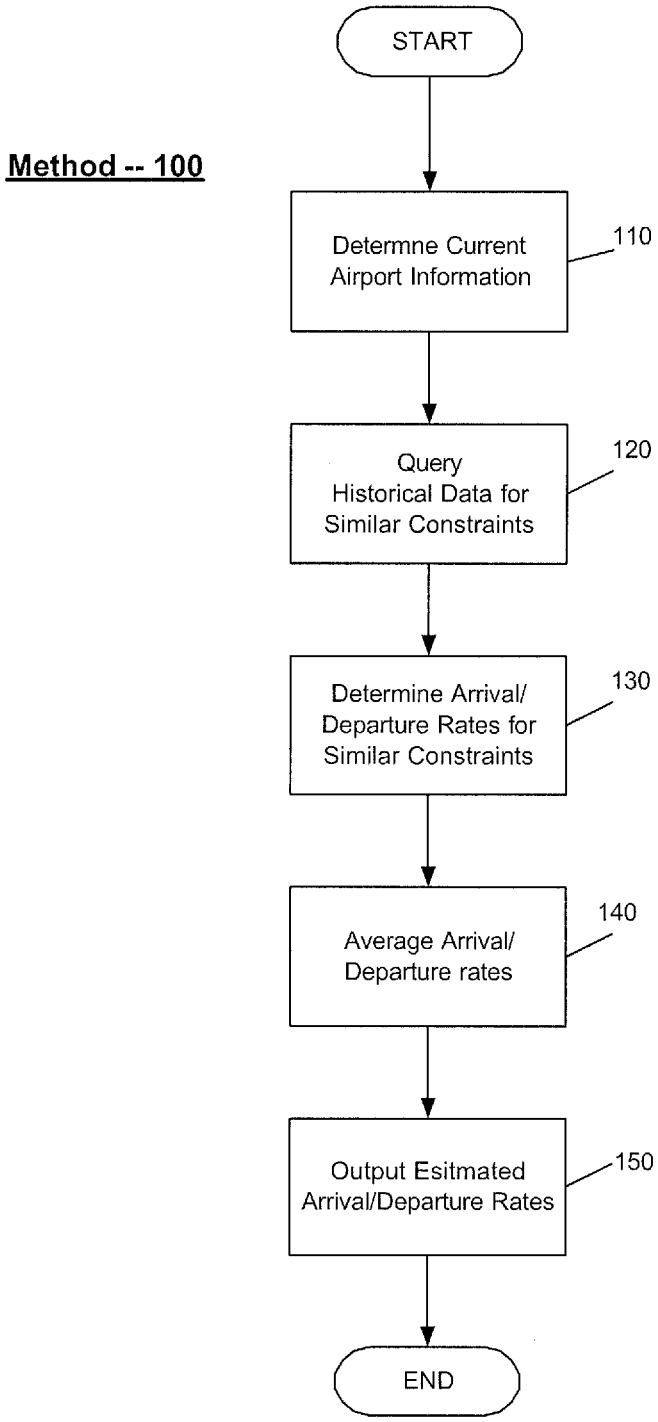
FIG. 4 provides an exemplary method for determining the estimated arrival and departure rates.

FIG. 4 provides an exemplary method 100 for determining the estimated arrival and departure rates. In step 110, the rate predictor 40 will query the data arrangements 10-30 for the current airport information such as TAF and runways configurations. As described above, this airport information may be a variety of types of information, but in this example, it will be considered that the information received is weather information and runway configuration. It should also be noted that the rate predictor 40 may not perform an actual query of the data feed arrangements 10-30, but rather the rate predictor 40 may receive data from the data feed arrangements 10-30 and buffer this data until it is needed.

In step 120, the rate predictor 40 will query the stored historical information to determine similar conditions for the airport that match the predicted weather and/or runway configurations. As described above, there may be general rules stored in the rate predictor 40 that are used to determine which conditions are similar for the purposes of matching constraints. It should be noted that throughout this description, it has been assumed that the queries are performed on a database structure that has been populated with appropriate data. However, those skilled in the art will understand that other types of searches may be performed using other methods of storing the types of data described herein.

In step 130, the rate predictor 40 will determine the actual departure and arrival rates for the periods having similar conditions. As described above, the number of periods may be limited to a specific number of periods (e.g., 20, 30, 40, etc.) or may be limited to a specific time (e.g., the previous 3 months). In step 140 the relevant departure and arrival rates are averaged to determine the estimated departure and arrival rates. At the completion of step 140, the rate predictor 40 will have determined the estimated departure and arrival rates and will output this information to the airport operator 50 in step 150. As described above, once the rate predictor 40 has the TAF and/or runway configuration information, the rate predictor 40 may further include additional search criteria to the historical data to refine the estimates.

It will be apparent to those skilled in the art that various modifications may be made in the present invention, without departing from the spirit or the scope of the invention. Thus, it is intended that the present invention cover modifications and variations of this invention provided they come within the scope of the appended claimed and their equivalents.

What is claimed is:

1. A method, comprising:

receiving, by a processor, predicted airport constraint information for a predetermined time period, the airport constraint information including weather constraint information;

querying, by the processor, historical Terminal Aerodrome Forecast data;

matching, by the processor, the predicted airport constraint information to a selected plurality of historical time periods having similar weather constraint information, the selected plurality of historical time periods including a historical time period immediately prior to the predetermined time period that has similar weather constraint information to the weather constraint information for the predetermined period;

determining, by the processor, actual arrival rates and actual departure rates during the selected plurality of historical time periods, wherein the determining includes averaging the actual arrival rates and the actual departure rates for the selected plurality of historical time periods;

determining, by the processor, one of an estimated arrival rate and an estimated departure rate for the predetermined time period based on actual arrival rates and actual departure rates for the selected plurality of historical time periods; and displaying the one of the estimated arrival rate and estimated departure rate.

2. The method of claim 1, wherein the airport constraint information further includes a runway configuration.

3. The method of claim 1, wherein the predetermined time period is one hour.

4. The method of claim 1, wherein the querying further includes determining a day or a time of day of the predetermined time period and limiting the query to the historical time periods matching the day or time of day.

5. The method of claim 1, wherein the selected plurality of historical time periods are limited to one of a predetermined number of historical time periods having similar constraint information or a predefined time span.

6. The method of claim 1, wherein the selected plurality of historical time periods comprises one of a predetermined quantity of time periods and a plurality of historical time periods within a predetermined time interval.

7. A system, comprising:

a data receiving arrangement receiving predicted airport constraint information for a predetermined time period, the airport constraint information including weather constraint information; and a processor querying historical Terminal Aerodrome Forecast data, matching the predicted airport constraint information to a selected plurality of historical time periods having similar weather constraint information, the selected plurality of historical time periods including a historical time period immediately prior to the predetermined time period that has similar weather constraint information to the weather constraint information for the predetermined period, determining actual arrival rates and actual departure rates during the historical time periods, wherein the processor averages the actual arrival rates and the actual departure rates for the selected plurality of historical time periods, determining one of an estimated arrival rate and an estimated departure rate for the predetermined time period based on actual arrival rates and actual departure rates for the selected plurality of historical time periods, and a data output arrangement outputting the one of the estimated arrival rate and estimated departure rate.

8. The system of claim 7, further comprising:

a memory storing the historical Terminal Aerodrome Forecast data.

9. The system of claim 7, wherein the airport constraint information further includes a runway configuration.

10. The system of claim 7, wherein the predetermined time period is one hour.

11. The system of claim 7, wherein the processor limits the query of the historical time periods to historical time periods matching a day or a time of day of the predetermined time period.

12. The system of claim 7, wherein the selected plurality of historical time periods are limited to one of a predetermined number of historical time periods having similar constraint information or a predefined time span.

13. The system of claim 7, wherein the selected plurality of historical time periods comprises one of a predetermined quantity of time periods and a plurality of historical time periods within a predetermined time interval.

14. A system comprising a non-transitory memory storing a set of instructions executable by a processor, the set of instructions being operable to:

receive predicted airport constraint information for a predetermined time period, the airport constraint information including weather constraint information;

query historical Terminal Aerodrome Forecast data;

match the predicted airport constraint information to a selected plurality of historical time periods having similar weather constraint information, the selected plurality of historical time periods including a historical time period immediately prior to the predetermined time period that has similar weather constraint information to the weather constraint information for the predetermined period;

determine one of an estimated arrival rate and an estimated departure rate for the selected plurality of predetermined time period based on averaging actual arrival rates and actual departure rates for the selected plurality of historical time periods; and display at least one of the estimated arrival rate and estimated departure rate.

15. The system of claim 14, wherein the selected plurality of historical time periods comprises one of a predetermined quantity of time periods and a plurality of historical time periods within a predetermined time interval.

* * * * *